United States Patent [19]

Heifetz

[11] 4,102,956

[45] Jul. 25, 1978

[54] BUILDING METHOD AND EQUIPMENT FOR USE THEREWITH

[76] Inventor: Haim Heifetz, 3 Bustanai Str., Ramat Hasharon, Israel

[21] Appl. No.: 653,509

[22] Filed: Jan. 29, 1976

[30] Foreign Application Priority Data

Jan. 29, 1975 [IL] Israel ..... 46523

[51] Int. Cl.[2] ..... E04B 1/16

[52] U.S. Cl. ..... 264/32; 52/2; 249/65; 264/34; 264/35; 264/314

[58] Field of Search ..... 264/314, 32, 34, 35; 52/2; 249/65

[56] References Cited

U.S. PATENT DOCUMENTS

| | | | |
|---|---|---|---|
| 2,324,554 | 7/1943 | Billner | 264/314 X |
| 2,335,300 | 11/1943 | Nett | 264/314 X |
| 2,624,931 | 1/1953 | Billner | 264/314 X |
| 2,731,055 | 1/1956 | Smith | 52/2 |
| 2,892,239 | 6/1959 | Nett | 264/314 X |
| 3,116,611 | 1/1964 | Margiloff | 52/2 X |
| 3,223,759 | 12/1965 | Williamson | 264/314 X |
| 3,462,521 | 8/1969 | Bini | 264/314 X |
| 3,643,910 | 2/1972 | Heifetz | 264/32 X |

*Primary Examiner*—Thomas P. Pavelko
*Attorney, Agent, or Firm*—Browdy and Neimark

[57] ABSTRACT

A building method of the kind wherein an inflatable former, made of a flexible, substantially inextensible material is sealingly anchored to a base and is inflated to a predetermined pressure and, while maintaining said pressure substantially constant, a cementitious material is applied to the outer surface of the former to a required thickness and, after the material has set, the former is deflated, released from the base and removed for reuse, including the steps of:

(a) inflating the former to a predetermined initial inflation pressure, (b) applying successive layers of cementitious material to said former, and (c) continuously or intermittently raising said inflation pressure in correspondence with the increasing thickness of said layers.

2 Claims, 10 Drawing Figures

BUILDING METHOD AND EQUIPMENT FOR USE THEREWITH

Figure 1:
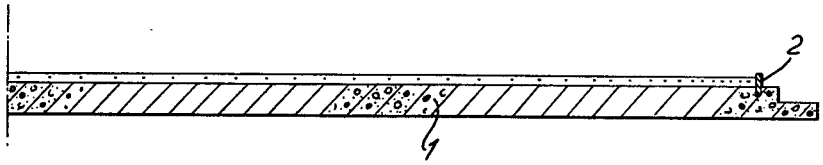

This invention relates to a building method, hereinafter referred to as being "a building method of the kind specified" wherein an inflatable former, made of a flexible, substantially inextensible material is sealingly achored to a base and is inflated to a predetermined pressure and, whilst maintaining said pressure substantially constant, a cementitious material is applied to the outer surface of the former to a required thickness and, after the material has set the former is deflated, released from the base and removed for reuse. Such a method is, for example, disclosed in my U.S. Pat. No. 3,643,910.

With hitherto known or proposed building methods of the kind specified the predetermined pressure is chosen on the one hand so as to ensure that the former is sufficiently rigid to withstand any distorting effects as a result of the applied load and on the other hand not so great as to impart an undue stress to the former material.

With buildings as heretofore constructed, in accordance with building methods of the kind specified, only a relatively thin wall thickness was required (bearing in mind the considerable strength of domelike shells). Accordingly, it has been possible to use formers, conventionally constructed of conventional materials, seeing that the loading of these formers by the cementitious material is not so great as to require the inflation of the former to a degree as to put an undue strain thereon.

Where, however, it is proposed, for any reason, to increase the wall thickness of the structure to be formed, the increased load of cementitious material would appear to render it impractical to use existing formers in view of the fact that these would have to be inflated to a sufficient degree to bear the additional load and such inflation would put undue and unbearable strain on the former material.

The production of such constructions with increased wall thickness is indicated where the construction is required to provide special protection such as is the case with air raid shelters, bunkers or the like.

It is an object of the present invention to provide a new and improved building method of the kind specified wherein structures of increased wall thickness capable of serving as air raid shelters, bunkers or the like can be effectively produced.

According to the present invention there is provided a building method of the kind specified including the steps of:

(a) inflating the former of a predetermined initial inflation pressure, (b) applying successive layers of cementitious material to the former, and (c) continuously or intermittently raising the inflation pressure in accordance with the increasing thickness of the layers.

Thus, with such a building method in accordance with the present invention, as the load on the former increases, the inflation pressure is increased so as to bear the load. On the other hand, the upwardly directed inflation pressure is counterbalanced by the downwardly directed load constituted by the cementitious layers and thus, as far as the former is concerned, an equilibrium is achieved between the upwardly and downwardly directed forces and the stresses transmitted to the former are maintained minimal. In consequence it is possible, in this way, to inflate the former to pressures far exceeding those which the former could withstand were these pressures not counterbalanced by corresponding pressures exerted by the load. In this way formers made of conventional materials can be utilized in the production of thick wall constructions such as air raid shelters, bunkers or the like.

Preferably the building method furthermore includes the steps of surrounding substantially vertical or steeply sloping portions of the former with shuttering walls spaced from these portions by a predetermined wall thickness, and casting the material in the space between the shuttering walls and the former and then proceeding with the application of the layers to the former.

Thus in accordance with this preferred method conventional shutterings are employed located at a predetermined spaced position from the vertical or steeply sloping portions of the former and these shutterings are used so as to cast the vertical or steeply sloping portions of the structure by conventional methods after which the successive layers of cementitious material are applied to the remaining portions of the former.

In accordance with a still further preferred embodiment the former is anchored to a base ring by clamping a rim of the former, of enlarged thickness as compared with the former walls, between the ring and appropriate clamping strips with the rim directed in the direction of inflation of the former.

With such a method of clamping, the inflation of the former results in the enlarged rim thereof being firmly and sealingly clamped between the ring and the clamping strips and, as a consequence, not only is the former effectively clamped to the ring but its degree of sealing improves with inflation. After the application and setting of the successive cementitious layers have been completed deflation of the former results in its collapse and detachment from the inner walls of the construction formed whereupon entry can be effected into the structure (through apertures such as window or door apertures) and the former can be unclamped from the ring.

In accordance with a further aspect of the present invention there is provided an inflatable former for use in a building of the kind specified and constituted of joined together segments of a flexible, substantially inelastic material, the segments forming portions of the former which are curved in two directions being of substantially lesser width than those segments which form portions of the former which are either not curved or are only curved in one direction.

Thus it has been found that with inflatable formers for use in a building method of the kind specified the greatest stress is exerted, during inflation, on those portions of the former which are curved in two directions. It has furthermore been found that these stresses are greatest in those regions of the constituent segments intermediate the connecting edges. Thus by making these segments of as narrow width as possible it can be ensured that the former can withstand inflation strains even in the regions where it is curved in more than two directions without the necessity of having to find special and highly expensive materials therefor.

For a better understanding of the present invention and to show how the same may be carried out in practice, reference will now be made to the accompanying drawings in which FIGS. 1 – 5 are views showing successive stages in carrying out a building method of the kind specified and in accordance with the present invention, and FIGS. 6 - 9 show the various components in stages involved in anchoring a former to a base for use in the building method.

As seen in the drawings the first step in constructing a structure of the kind specified for use as an airraid shelter or bunker involves casting a concrete base 1 of required thickness and reinforcement into which is set a peripheral anchoring ring 2 to be described in detail below.

Figure 2:
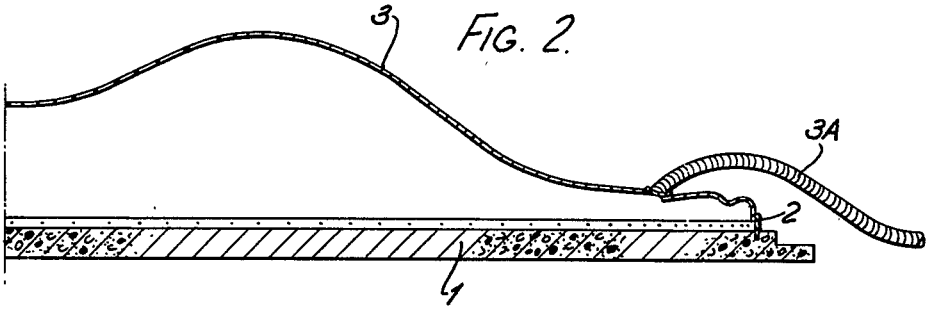

As seen in FIG. 2 of the drawings there is anchored to the ring 2 by a method to be described below, a flexible former 3 which is coupled by means of a pipe 3*a* to an air pressure source (not shown) designed to provide compressed air to the interior of the former 3 at a required pressure at which it is maintained. The process of inflating the former is shown in FIG. 2 of the drawings.

Figure 3:
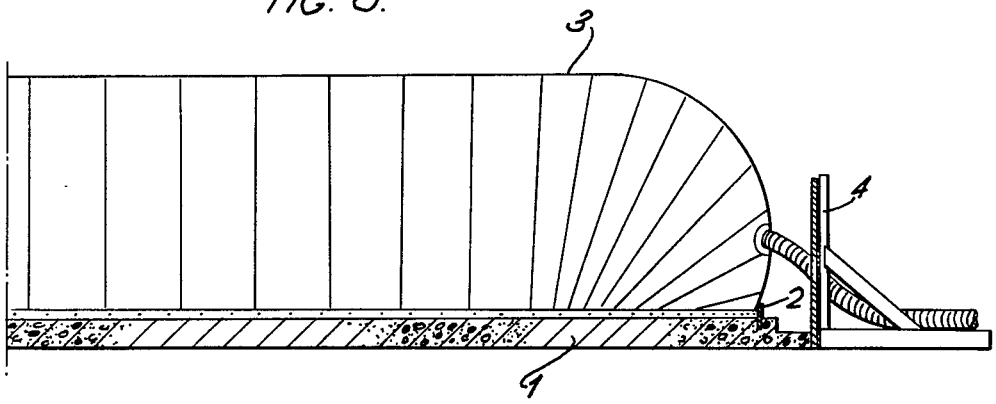
Figure 9:
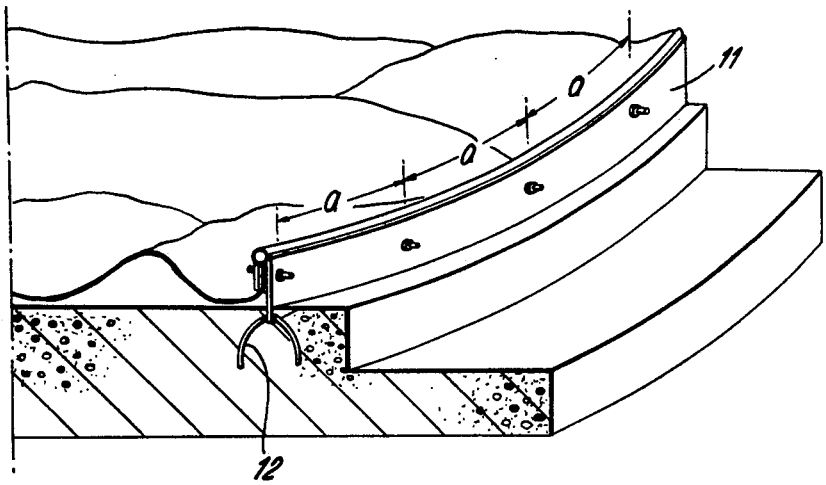
Figure 10:
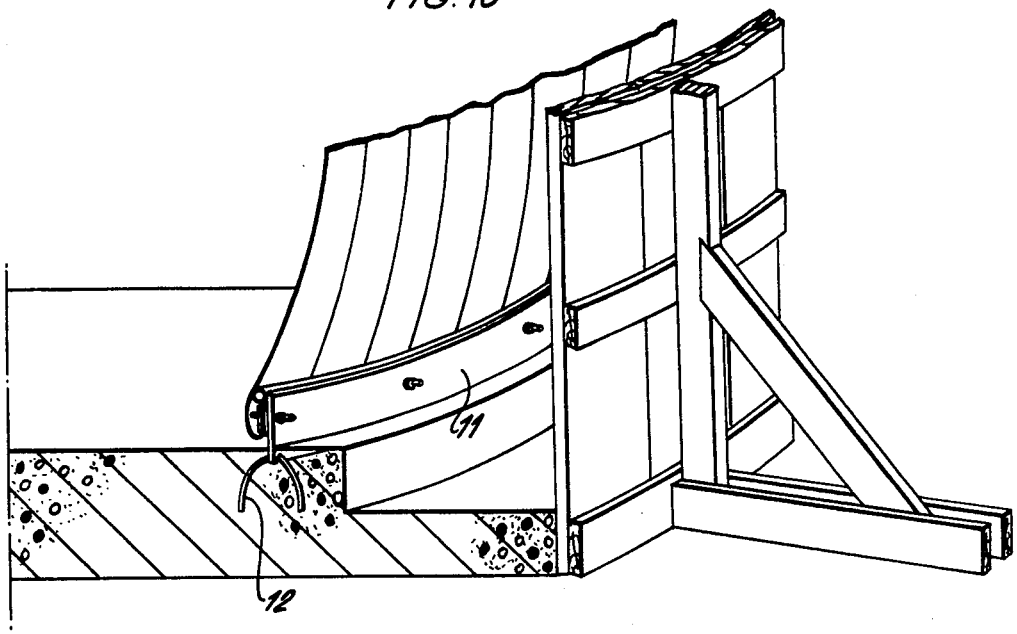

As seen in FIG. 3 of the drawings the inflated former 3 has its vertical or near vertical portions surrounded by vertical shuttering 4 of convention form (shown in detail in FIG. 9).

The former 3 has now placed thereon a reinforcing mesh (not shown) whilst suitably shaped shuttering (not shown) is applied to those portions of the former wherein window or door apertures or the like are to be formed.

Figure 4:
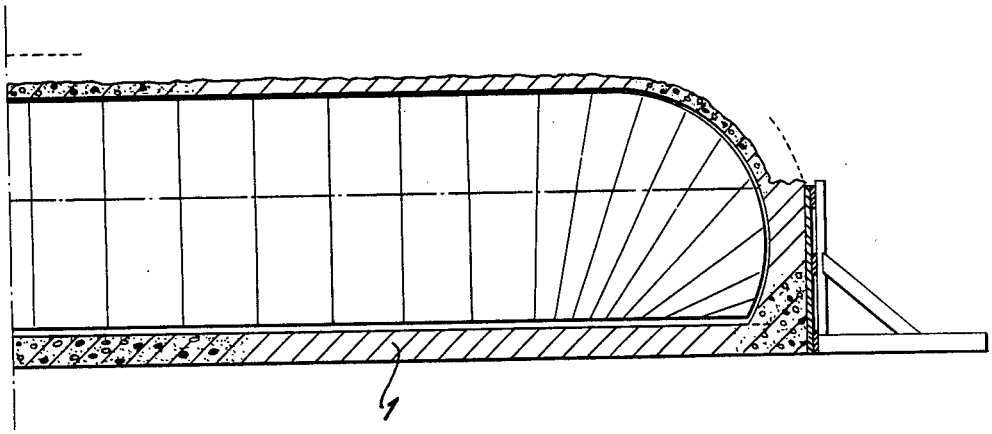

As seen in FIG. 4 of the drawings, with the former 3 inflated to a first predetermined pressure, concrete is cast into the region between the vertical shutterings and the former and a first layer of cementitious material is applied to the former proper. Successive layers are then applied and at the same time the inflation pressure in the former is continuously or intermittently raised in accordance with the increasing thickness of the layers.

Thus, the increasing load of the applied cementitious layers is at all times counterbalanced by the increasing inflation pressure within the former and in this way the stresses and strains applied to the former as a result of its inflation is kept down to a minimum.

Those portions of the former which are not covered by the cementitious layers (the door and window apertures, etc.) are not subjected to undue strains seeing that they are on the one hand of relatively limited area and on the other hand they are constrained by the reinforcing mesh applied thereto.

Thus, in a particular example the first layer of cementitious material applied to the former is of about 5 cm thickness the applied concrete being high quality concrete having a low slump and quick setting properties. For this purpose the former is initially inflated to an inflation pressure of about 500 kg/m$^2$ and with the completion of the casting of the first layer the pressure is raised by about 100 kg/m$^2$ this being roughly equivalent to the loading pressure effected by the first layer. After completing the application of the first layer the inflation pressure is increased by an amount corresponding to between half to the full loading pressure exerted by the second layer and so on. When the complete wall thickness has been applied (say about 35 cm corresponding to a loading pressure of 800 kg/m$^2$) the internal inflation pressure of the balloon is of the order of 1000 kg/m$^2$. Thus at all times the balloon does not have to bear a strain greater than that for which it has been designed.

During the application of the successive layers it must be ensured that each layer is full and compact so as not to leave air pockets with the concrete.

Figure 5:
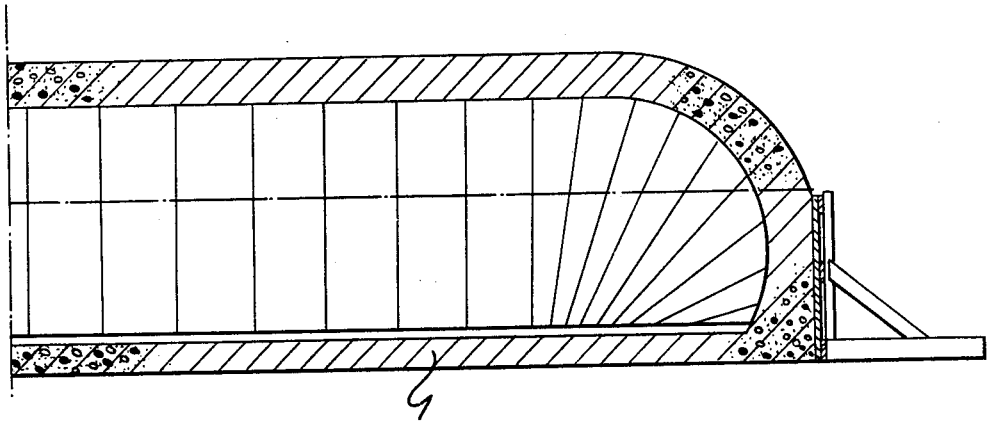
Figure 6:
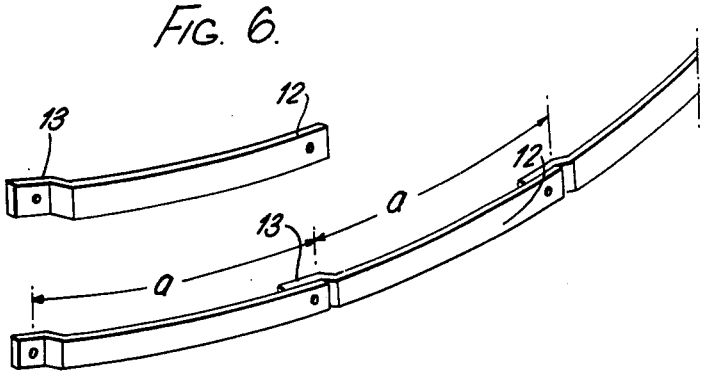

As seen clearly in FIGS. 3, 4 and 5 of the drawings the former which is constructed of segments of suitable plastic material such as PVC or the like is formed of segments of standard width i.e. 100 cms½ in those regions where the former is either not curved or only curved in a single direction whilst in those regions where the former is curved in two directions i.e. in the end regions of the former the segments are of much narrower width (say 50 cms). In this way it is ensured that the stresses applied to the former in the regions of curvature in two directions are easily withstood seeing that these stresses are mainly effective in the central positions of the segments rather than at their connecting edges and by reducing the width of these end segments the resistance of the former to strain is considerably increased.

With the completion of the casting and setting of the structure the former is deflated and collapses whereupon workers can enter the structure through the apertures which have been preformed and remove the former for subsequent reuse.

Reference will now be made to FIGS. 6–9 of the drawings in which are shown in detail the method of clamping the former to a base ring.

Figure 7:
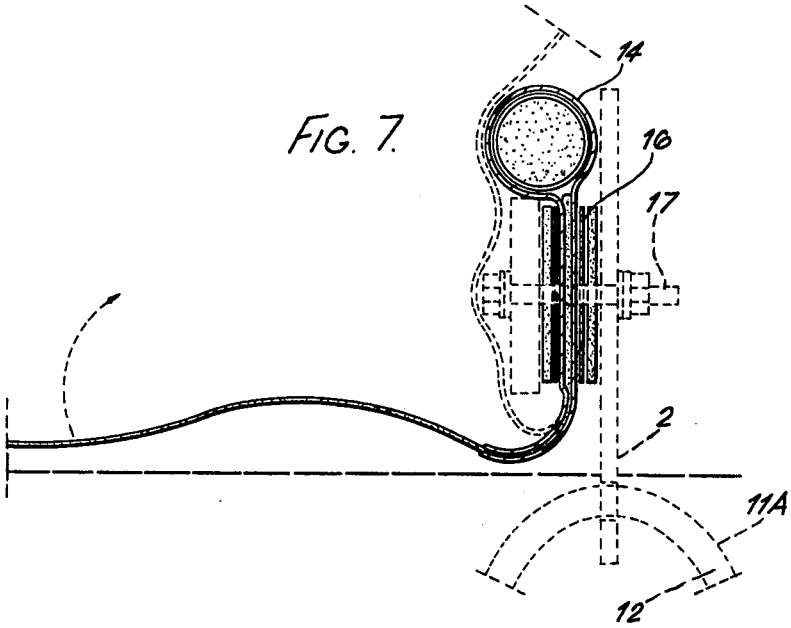
Figure 8:
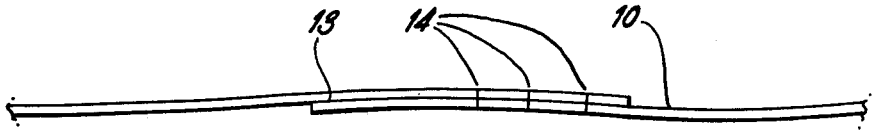

As seen particularly in FIGS. 7, 8 and 9 the base ring 2 consists of circular steel segments 11 (e.g. of 2–3 mm thickness and 12 cms length) which are set into the base 1 prior to the setting of the latter and are provided with anchoring hooks 11A so as to obviate the possibility of these segments 11 being torn out of the concrete base 1 when the former 3 has been inflated.

There are furthermore provided clamping segments 12, shown in FIG. 6A of the drawings, one end 13 of each clamping segment 12 being slightly offset with respect to the major portion thereof so that this end 13 can overlie an adjacent end of a succeeding segment 12 as shown in FIG. 6B of the drawings.

A rim 14 of the former 3 is constituted by a doubled over portion which encloses a flexible cable 15. With rim 14 uppermost, the adjacent former edge is clamped between the base ring 2 (constituted by the segments 11) and the clamping segments 12, the base ring 2 and the clamping segments 12 being respectively separated from the former edge by foam strips 16. In this position, anchoring bolts 17 are passed through aligned apertures formed in the base and clamping segments and former edges and the former 3 is, in this way, firmly clamped to the base ring 2.

Thus, as the former 3 is inflated, the enlarged rim 14 is pulled downwardly thereby effectively sealing the former against escape of air.

Shuttering 4 as shown in detail in FIG. 9 of the drawings is then placed in position and the concrete is cast and applied as described above.

With the completion of casting, the edges of the bolts 17 projecting outwardly from the ring are embedded in the cast concrete. On the other hand with the deflation and collapse of the former 3 the former rim 14 can be unbolted from the base ring 2 and the former can be rolled up and removed from the structure through one of its apertures for subsequent reuse. Similarly the clamping segments 12 which are preferably of modular size can also be removed for subsequent reuse.

By having the base ring and clamping segments of modular size it is possible to reduce to a minimum the number of different types of elements which must be stored in order to produce structures of differing sizes.

The structure is now ready for finishing and construction of internal partitions.

In certain circumstances the former should be provided with an integrally formed flexible base which serves to seal the former. This may be necessary for example when the structure is to be erected above an apertured base or on an upper storey.

The structures thus formed being of substantially increased wall thickness can effectively serve for reinforced structures such as bunkers or the like.

I claim:

1. A building method of the kind wherein an inflatable former, made of a flexible, substantially inextensible material, is sealingly anchored to a base and is inflated to a predetermined pressure and, whilst maintaining said pressure substantially constant, cementitious material is applied to the outer surface of the former to a required thickness and after the material has set the former is deflated, released from the base and removed for reuse, including the steps of:

(a) pneumatically inflating the former to a predetermined initial inflation pressure;

(b) surrounding substantially vertical or steeply sloping portions of said former with shuttering walls spaced from said portions by a predetermined wall thickness;

(c) casting cementitious material in the space between said shuttering walls and said former;

(d) applying successive layers of cementitious material to remaining portions of said former; and (e) continuously or intermittently raising said inflation pressure from an external source to an extent substantially equivalent to the oppositely directed successive loads applied to said former as a consequence of the increasing thickness of said layers;

whereby side wall bulging is eliminated.

2. In a building method of the kind wherein an inflatable former, made of a flexible, substantially inextensible material, is sealingly anchored to a base and is inflated to a predetermined pressure and, whilst maintaining said pressure substantially constant, a cementitious material is applied to the outer surface of the former to a required thickness and after the material has set the former is deflated, released from the base and removed for reuse, the improvement comprising anchoring the former to a continuous vertical base ring anchored to the base, surrounding the former, by clamping a peripheral portion of said former adjacent a rim of said former, said rim being of flexible material of enlarged thickness as compared with the former walls, between the interior of said ring and appropriate clamping strips with said rim directed in the direction of inflation of said former and contacting said base ring above said clamping strips, said peripheral portion being bent back with respect to the former walls, such that leakage between said rim and said base ring is substantially eliminated.

* * * * *